US008375773B2

(12) United States Patent
Lunkad et al.

(10) Patent No.: US 8,375,773 B2
(45) Date of Patent: Feb. 19, 2013

(54) METHODS FOR CONTACTING A SURFACE WITH A FLUID CONTAINING A MARKER TO DETERMINE THE WETTABILITY OF THE SURFACE

(75) Inventors: Siddhartha F. Lunkad, Pune (IN); Balasundaram Balaraman, Pune (IN); Abhimanyu Deshpande, Pune (IN); Christopher L. Gordon, Roanoke, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 879 days.

(21) Appl. No.: 12/502,062

(22) Filed: Jul. 13, 2009

(65) Prior Publication Data

US 2011/0005310 A1 Jan. 13, 2011

(51) Int. Cl.
*G01N 13/00* (2006.01)
*E21B 47/10* (2012.01)

(52) U.S. Cl. ..... 73/64.48; 73/152.18

(58) Field of Classification Search ..... 73/152.18, 73/64.48, 64.52; 166/250.14, 292
See application file for complete search history.

(56) References Cited

U.S. PATENT DOCUMENTS

| | | | | |
|---|---|---|---|---|
| H1932 | H | 1/2001 | Heathman et al. | |
| 7,293,609 | B2 | 11/2007 | Dealy et al. | |
| 2006/0060351 | A1 * | 3/2006 | Heathman et al. | 166/250.14 |
| 2009/0087912 | A1 | 4/2009 | Ramos et al. | |

OTHER PUBLICATIONS

C.D. Christian, D.R. Ellis, J.J. Brege, L. Quintero, D.E. Clark: "The development of an effective water-wetting cement spacer for the displacement of non-aqueous fluids (NAF)", AADE Technical Conference and Exhibition, Mar. 31, 2009, Apr. 2, 2009, pp. 1-5 XP002621829, New Orleans.

A. Ataki, P.Kolb, U. Buhlman, H.-J.Bart: "Wetting performance and pressure drop of structured packings: CFD and experiment", Symposium Series Institution of Chemical Engineers, 2006, pp. 534-543, XP002621830.

W.E.Kline, E.M.Kocian, W.E. Smith: "Evaluation of cementing practices by quantitative radiotracer measurements", IADC/SPE, 14778, Feb. 10, 1986-Feb. 12, 1986, pp. 441-449. XP002621831.

PCT International Search Report, PCT/GB2010/001311, issued Feb. 24, 2011.

O.C. Holbrook, G.G. Bernard: "Determination of wettability by dye adsorption", Petroleum Transaction, AIME, Oct. 6, 1957, Oct. 9, 1957, pp. 261-264, XP002621828.

* cited by examiner

*Primary Examiner* — Peter Macchiarolo
*Assistant Examiner* — Jamar Ray
(74) *Attorney, Agent, or Firm* — Craig W. Roddy; Booth Albanesi Schroeder LLC

(57) ABSTRACT

Methods of determining the wettability of a surface under predetermined conditions, wherein the surface simulates or is a downhole surface for use in an oil or gas operation. The methods include the steps of: (A) contacting the surface with at least a first fluid; and then (B) observing the surface for the presence or absence of a marker to determine the wettability of the surface. According to a first aspect of the inventions, the first fluid comprises a first marker, and the step of contacting is under first predetermined conditions. This aspect also includes the additional step of contacting the surface with a second fluid comprising a second marker. According to a second aspect of the inventions, the step of contacting the surface with the first fluid is under predetermined conditions, and the surface is contacted with a second fluid comprising a second marker. According to a third aspect of the inventions, the first fluid comprises a first marker, the surface is contacted with a second fluid comprising a second marker, and both steps of contacting are performed under predetermined conditions.

22 Claims, 4 Drawing Sheets

METHODS FOR CONTACTING A SURFACE WITH A FLUID CONTAINING A MARKER TO DETERMINE THE WETTABILITY OF THE SURFACE

CROSS-REFERENCE TO RELATED APPLICATIONS

Not applicable

STATEMENT REGARDING FEDERALLY SPONSORED RESEARCH OR DEVELOPMENT

Not applicable

REFERENCE TO MICROFICHE APPENDIX

Not applicable

BACKGROUND OF THE INVENTION

In one manner of drilling a well, "drilling mud" is pumped into a rotated drill string to which a drill bit is attached. The mud typically exits through openings in the drill bit to lubricate the bit and to carry cuttings up an annulus between the drill string and the wellbore for disposal at the surface. One type of drilling mud is an emulsion of substances which defines a non-aqueous external phase and an aqueous internal phase. In this drilling mud, a non-aqueous "oleaginous" external phase (e.g., oil or synthetic polymers) is used to inhibit swelling of water-sensitive drill cuttings (e.g., shale). It is known in the art that typical oil-based drilling fluids contain some amount of an internal aqueous phase. Typically, an aqueous (water-based) internal phase comprised of salts such as calcium chloride is used to prepare the emulsion structure, imparting viscous properties to the drilling fluid. Additionally, a composition of these oil or synthetic-based drilling fluids typically includes chemical emulsifying agents, which act to form the oleaginous external phase emulsions, also known as "invert" emulsions. These agents also promote oil-wet surfaces. This oil-wetted state promotes lubrication of the drilling bit and further stabilization of formation materials. Such a drilling fluid can be made as known in the art.

After drilling is completed, the drill string or some other string of tubular members (including, for example, liner, casing, or one or more cementing tools) typically is cemented in the wellbore as part of completing the well. One type of cementing operation includes pumping cement down through the string and out into the annulus to displace the drilling mud from the annulus to the surface (however, flow in the opposite direction can occur in some operations, such as in reverse circulating or reverse cementing). A successful cementing operation also includes bonding the cement with the outer surface of the string and the inner surface of the wellbore defining the annulus.

Bonding of the cement to the tubular string or to the wellbore surface can be less than desirable if the string and wellbore surfaces are not conducive to cement bonding. Of particular relevance to the present invention, coatings from the non-aqueous portion of the drilling fluid can interfere with the bonding because the aqueous cement does not bond readily with the non-aqueous substances of the drilling mud. If improper bonding occurs at either of these surfaces, a thin region called a "micro-annulus" can occur. Formation of a micro-annulus can lead to undesirable fluid migration outside the wellbore casing, thus, losing zonal isolation of the wellbore. Further, casing lifetime may be compromised if migrating fluids are corrosive.

To promote proper bonding, an important aspect of oil or gas well cementing is the proper displacement of the drilling fluid from the annular space between the formation and casing or between inner casing and larger outer casing in such a fashion that the formation or casing surfaces may form hydraulic bonds with the cementing slurry. This bond forms best when these surfaces are water-wet. Thus, the displacing fluid must act as an inverter fluid but must also leave the formation or casing surfaces in a water-wet state.

A displacing fluid can be pumped ahead of the cement to create water-wet surfaces. Such fluids include spacers, preflushes, scavenger fluids, or sacrificial slurries, for example. The types of such fluids relevant to the present invention are those which are intended to cause the coatings of non-aqueous (e.g., "oleaginous") external/aqueous internal drilling muds to invert so that the aqueous phase inverts with the oleaginous phase whereby the aqueous substance is external. These include the primary fluid itself, such as a cement slurry having suitable surfactants. Fluids which cause this inversion are referred to in this description and in the claims as "inverter fluids." Typically, such inverter fluids are used as a displacement or displacing fluid.

Such inverter fluids are also used to displace oleaginous external/aqueous internal fluids from cased hole or open hole wellbores in operations other than cementing. One example is to replace these fluids with a completion fluid such as a solution of calcium chloride or bromide. This operation is conducted to clean the wellbore for further operation, such as perforation of the casing or, in the case of open hole, production of the well. In this case, the inverter fluid serves to displace the previous fluid and leave the formation surfaces in a water-wet state.

SUMMARY OF THE INVENTION

The inventions are methods for determining the wettability of a surface under predetermined conditions, wherein the surface simulates or is a downhole surface for use in an oil or gas operation.

According to a first aspect of the inventions, methods are provided that include the steps of: (A) selecting a first fluid wherein the first fluid simulates or is a downhole fluid for use in an oil or gas operation; (B) contacting the surface with the first fluid under first predetermined conditions, (i) wherein the first fluid comprises: (a) a first base fluid, wherein the first base fluid is aqueous or non-aqueous; and (b) a first marker, (ii) wherein the first marker is soluble in the first base fluid, and wherein the first marker reflects, emits, or is excited to emit a first observable property, (iii) wherein the first observable property is distinguishable from the reflected, emitted, or excited to be emitted observable properties of the first base fluid, and wherein the first observable property is electromagnetic radiation or radioactivity, and (iv) wherein the first predetermined conditions comprise: (a) a shear rate; (b) a time; and (c) a temperature; (C) separating the surface from the first fluid, wherein after the step of separating, a film of the first fluid can remain on the surface; and (D) observing the surface for the presence or absence of the first marker to determine the wettability of the surface.

According to a second aspect of the inventions, methods are provided that include the steps of: (A) selecting a first fluid wherein the first fluid simulates or is a downhole fluid for use in an oil or gas operation; (B) contacting the surface with the first fluid under first predetermined conditions, (i) wherein the first fluid comprises a first base fluid, (ii) wherein the first base fluid is aqueous or non-aqueous, and (iii) wherein the first predetermined conditions comprise: (a) a shear rate; (b) a time; and (c) a temperature; (C) separating the surface from the first fluid, wherein after the step of separating, a film of the first fluid can remain on the surface; (D) selecting a second fluid wherein the second fluid simulates or is a downhole fluid for use in an oil or gas operation; (E) contacting the surface with the second fluid, (i) wherein the second fluid comprises: (a) a second base fluid, wherein the second base fluid is aqueous or non-aqueous, and wherein the second base fluid is different from the first base fluid; and (b) a second marker, (ii) wherein the second marker is soluble in the second base fluid and insoluble in the first base fluid, and wherein the second marker reflects, emits, or is excited to emit a second observable property, (iii) wherein the second observable property is distinguishable from the reflected, emitted, or excited to be emitted observable properties of the first and second base fluids, and wherein the second observable property is electromagnetic radiation or radioactivity; (F) separating the surface from the second fluid, wherein after the step of separating, a film of the second fluid can remain on the surface; and (G) observing the surface for the presence or absence of the second marker to determine the wettability of the surface.

According to a third aspect of the inventions, methods are provided that include the steps of: (A) selecting a first fluid wherein the first fluid simulates or is a downhole fluid for use in an oil or gas operation; (B) contacting the surface with the first fluid under first predetermined conditions, (i) wherein the first fluid comprises: (a) a first base fluid, wherein the first base fluid is aqueous or non-aqueous; and (b) a first marker; (C) separating the surface from the first fluid, wherein after the step of separating, a film of the first fluid can remain on the surface; (D) selecting a second fluid wherein the second fluid simulates or is a downhole fluid for use in an oil or gas operation; (E) contacting the surface with the second fluid under second predetermined conditions, (i) wherein the second fluid comprises: (a) a second base fluid, wherein the second base fluid is aqueous or non-aqueous, and wherein the second base fluid is different from the first base fluid; and (b) a second marker, (ii) wherein the first marker is soluble in the first base fluid and insoluble in the second base fluid, and wherein the first marker reflects, emits, or is excited to emit a first observable property, (iii) wherein the second marker is soluble in the second base fluid and insoluble in the first base fluid, and wherein the second marker reflects, emits, or is excited to emit a second observable property, (iv) wherein the first observable property is distinguishable from the reflected, emitted, or excited to be emitted observable properties of the first and second base fluids, wherein the second observable property is distinguishable from the reflected, emitted, or excited to be emitted observable properties of the first and second base fluids and the first observable property of the first marker, and wherein the first and second observable properties are electromagnetic radiation or radioactivity, (v) wherein the first and second predetermined conditions comprise: (a) a shear rate; (b) a time; and (c) a temperature; (F) separating the surface from the second fluid, wherein after the step of separating, a film of the second fluid can remain on the surface; and (G) observing the surface for the presence or absence of the first marker and the second marker to determine the wettability of the surface.

As used herein, the words "comprise," "have," "include," and all grammatical variations thereof are each intended to have an open, non-limiting meaning that does not exclude additional elements or steps. It should also be understood that as used herein, "first" and "second" are assigned arbitrarily and are merely intended to differentiate between two or more fluids, markers, etc., as the case may be, and do not indicate any sequence. Furthermore, it is to be understood that the mere use of the term "first" does not require that there be any "second," and the mere use of the word "second" does not require that there be any "third."

BRIEF DESCRIPTION OF THE DRAWING

The patent or application contains at least one drawing executed in color. Copies of this patent or patent application publication with color drawing(s) will be provided by the Office upon request and payment of the necessary fee.

The accompanying drawing is incorporated into and forms a part of the specification to illustrate examples according to the presently most-preferred embodiments of the present inventions. The drawing is only for illustration of the inventions and is not to be construed as limiting the inventions to only the illustrated and described examples. The drawing includes the following figures.

DETAILED DESCRIPTION OF THE INVENTIONS

Figure 1:
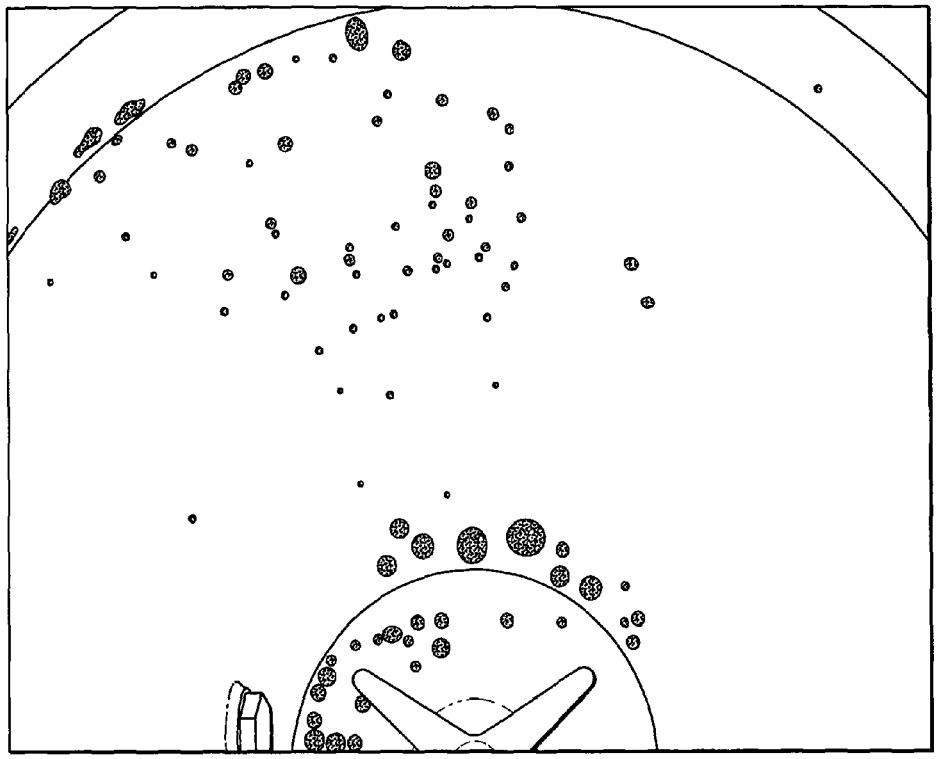
FIG. 1 illustrates an oil-wet surface (the interior metal surface of a testing apparatus) with the use of an aqueous fluid containing a water-soluble blue dye as a marker.

As used herein, "wettability" means the preference of a surface to be in contact with one liquid or gas rather than another. As used herein, "oil-wet" means the preference of a surface to be in contact with an oil phase rather than a water phase or gas phase. As used herein, "water-wet" means the preference of a surface to be in contact with a water phase rather than an oil phase or gas phase.

In order to produce oil or gas, a well is drilled into a subterranean formation. A "well" includes a wellbore that penetrates a subterranean formation. As used herein, the term "downhole" means previously used, occurring, or contemplated to be used in a drilled well or a subterranean formation surrounding a well.

A heterogeneous fluid has an external phase and at least one internal phase. By contrast, a homogenous fluid does not have distinct phases. The term "external phase" of a fluid is synonymous with the term continuous phase of a fluid. Moreover, the term "internal phase" is synonymous with the term discontinuous or dispersed phase of a fluid.

As used herein, each of the "first fluid" or the "second fluid" can be a homogenous or heterogeneous fluid. Each of the first fluid and the second fluid comprises a first and second base fluid, respectively. If the first fluid is a heterogeneous fluid, then the external phase of the first fluid is the first base fluid. If the second fluid is a heterogeneous fluid, then the external phase of the second fluid is the second base fluid. As used herein, a "base fluid" means a homogenous fluid.

Each of the first fluid and second fluid is aqueous or non-aqueous. An example of an aqueous fluid is an aqueous-based spacer fluid. As used herein, the term "aqueous-based" fluid means an aqueous homogenous fluid or a heterogeneous fluid having an aqueous external phase. Accordingly, one example of an aqueous first or second fluid is water containing dissolved solids. By way of another example, an aqueous first or second fluid is a fluid having water as the external phase and an oil as the internal phase.

An example of a non-aqueous fluid is an oil-based fluid. As used herein, the term "oil-based" fluid means an oleaginous homogenous fluid or a heterogeneous fluid having an oleaginous external phase. As commonly understood, "oil" means and refers to a slippery or viscous liquid or liquefiable substance not miscible with water. Examples of oil include petroleum, crude oil, a synthetic oleaginous polymer, or any combination thereof. Accordingly, one example of a non-aqueous first or second fluid is a homogenous oil. By way of another example, a non-aqueous first or second fluid is a fluid having an oleaginous synthetic polymer as the external phase and water as an internal phase. For example, a non-aqueous fluid can be a single oil, a mixture of different oils, a mixture of a single oil and other miscible components, or an oil-based mud.

The inventions are directed to methods of determining the wettability of a surface under predetermined conditions, wherein the surface simulates or is a downhole surface for use in an oil or gas operation. More particularly, the inventions provide methods for testing the surface using markers to determine wettability. According to a first aspect of the inventions, methods are provided that include the steps of: (A) selecting a first fluid wherein the first fluid simulates or is a downhole fluid for use in an oil or gas operation; (B) contacting the surface with the first fluid under first predetermined conditions, (i) wherein the first fluid comprises: (a) a first base fluid, wherein the first base fluid is aqueous or non-aqueous; and (b) a first marker, (ii) wherein the first marker is soluble in the first base fluid, and wherein the first marker reflects, emits, or is excited to emit a first observable property, (iii) wherein the first observable property is distinguishable from the reflected, emitted, or excited to be emitted observable properties of the first base fluid, and wherein the first observable property is electromagnetic radiation or radioactivity, and (iv) wherein the first predetermined conditions comprise: (a) a shear rate; (b) a time; and (c) a temperature; (C) separating the surface from the first fluid, wherein after the step of separating, a film of the first fluid can remain on the surface; and (D) observing the surface for the presence or absence of the first marker to determine the wettability of the surface.

According to a second aspect of the inventions, methods are provided that include the steps of: (A) selecting a first fluid wherein the first fluid simulates or is a downhole fluid for use in an oil or gas operation; (B) contacting the surface with the first fluid under first predetermined conditions, (i) wherein the first fluid comprises a first base fluid, (ii) wherein the first base fluid is aqueous or non-aqueous, and (iii) wherein the first predetermined conditions comprise: (a) a shear rate; (b) a time; and (c) a temperature; (C) separating the surface from the first fluid, wherein after the step of separating, a film of the first fluid can remain on the surface; (D) selecting a second fluid wherein the second fluid simulates or is a downhole fluid for use in an oil or gas operation; (E) contacting the surface with the second fluid, (i) wherein the second fluid comprises: (a) a second base fluid, wherein the second base fluid is aqueous or non-aqueous, and wherein the second base fluid is different from the first base fluid; and (b) a second marker, (ii) wherein the second marker is soluble in the second base fluid and insoluble in the first base fluid, and wherein the second marker reflects, emits, or is excited to emit a second observable property, (iii) wherein the second observable property is distinguishable from the reflected, emitted, or excited to be emitted observable properties of the first and second base fluids, and wherein the second observable property is electromagnetic radiation or radioactivity; (F) separating the surface from the second fluid, wherein after the step of separating, a film of the second fluid can remain on the surface; and (G) observing the surface for the presence or absence of the second marker to determine the wettability of the surface.

According to a third aspect of the inventions, methods are provided that include the steps of: (A) selecting a first fluid wherein the first fluid simulates or is a downhole fluid for use in an oil or gas operation; (B) contacting the surface with the first fluid under first predetermined conditions, (i) wherein the first fluid comprises: (a) a first base fluid, wherein the first base fluid is aqueous or non-aqueous; and (b) a first marker; (C) separating the surface from the first fluid, wherein after the step of separating, a film of the first fluid can remain on the surface; (D) selecting a second fluid wherein the second fluid simulates or is a downhole fluid for use in an oil or gas operation; (E) contacting the surface with the second fluid under second predetermined conditions, (i) wherein the second fluid comprises: (a) a second base fluid, wherein the second base fluid is aqueous or non-aqueous, and wherein the second base fluid is different from the first base fluid; and (b) a second marker, (ii) wherein the first marker is soluble in the first base fluid and insoluble in the second base fluid, and wherein the first marker reflects, emits, or is excited to emit a first observable property, (iii) wherein the second marker is soluble in the second base fluid and insoluble in the first base fluid, and wherein the second marker reflects, emits, or is excited to emit a second observable property, (iv) wherein the first observable property is distinguishable from the reflected, emitted, or excited to be emitted observable properties of the first and second base fluids, wherein the second observable property is distinguishable from the reflected, emitted, or excited to be emitted observable properties of the first and second base fluids and the first observable property of the first marker, and wherein the first and second observable properties are electromagnetic radiation or radioactivity, (v) wherein the first and second predetermined conditions comprise: (a) a shear rate; (b) a time; and (c) a temperature; (F) separating the surface from the second fluid, wherein after the step of separating, a film of the second fluid can remain on the surface; and (G) observing the surface for the presence or absence of the first marker and the second marker to determine the wettability of the surface.

The methods include the step of selecting a first fluid wherein the first fluid simulates or is a downhole fluid for use in an oil or gas operation. Examples of a downhole fluid include, but are not limited to, drilling, completion, cementing, stimulation, and treatment fluids. Preferably, the downhole fluid is selected from an oil-based mud, an oil-based mud mixed with a spacer fluid, an oil-based mud mixed with a spacer fluid and a surfactant, a spacer fluid, and a spacer fluid mixed with a surfactant.

If a second fluid is used, then the methods include the step of selecting a second fluid wherein the second fluid simulates or is a downhole fluid for use in an oil or gas operation. Examples of a downhole fluid include, but are not limited to, drilling, completion, cementing, stimulation, and treatment fluids. Preferably, the downhole fluid for selection of the second fluid is selected from an oil-based mud, an oil-based mud mixed with a spacer fluid, an oil-based mud mixed with a spacer fluid and a surfactant, a spacer fluid, and a spacer fluid mixed with a surfactant. More preferably, the downhole fluid for selection of the second fluid is water, an aqueous-based spacer fluid, an aqueous-based spacer fluid mixed with a surfactant, or an inverter fluid.

The surface tested can be contacted with the first or second fluid under predetermined conditions using a testing apparatus and procedures described in application Ser. No. 09/281,719, published on Jan. 2, 2001, having for named inventors James F. Heathman, J. Michael Wilson, and James H. Cantrell, which is incorporated herein by reference in its entirety. It is to be understood, that, if there are conflicting definitions between words contained in the above-cited reference and words contained herein, then the definitions contained herein control the intended meaning. If the surface is not contacted under predetermined conditions, then the surface can be contacted with the first or second fluid by submersing the surface in the fluid or by pouring the fluid over the surface.

The surface simulates or is a downhole surface for use in an oil or gas operation. The methods preferably include the step of selecting a surface wherein the surface simulates or is a downhole surface for use in an oil or gas operation before the step of contacting the surface with the first fluid. The downhole surface can be impermeable or permeable. The downhole surface, whether impermeable or permeable, is preferably a surface contacted by a downhole fluid. An impermeable downhole surface can be, for example, a downhole tubular, casing, liner, or cementing tool. An impermeable downhole surface can be, for example, made of a metal, carbon fibers, glass fibers, or ceramics. If the impermeable downhole surface is a metal, then the metal is preferably selected from 5CT metals approved by the American Petroleum Industry (API). Examples of 5CT metals include, but are not limited to, stainless steel, mild steel, and alloy steel.

The downhole surface can be a permeable downhole surface. A permeable downhole surface can be, for example, a portion of a subterranean formation, such as a rock or weakly-consolidated formation, or a mudcake. As used herein, the word "rock" is used in the geological sense to refer to an aggregate of minerals or organic matter or volcanic glass, such as may be encountered downhole.

The methods provide for contacting the surface with at least a first fluid. The first fluid includes a first base fluid. The first base fluid can be aqueous or non-aqueous.

The first fluid can contain components including, but not limited to, proppant, a suspending agent, a cross-linker for the suspending agent, a breaker, salt, a breaker aid, a co-surfactant, an oxygen scavenger, an alcohol, a scale inhibitor, a corrosion inhibitor, a fluid-loss additive, an oxidizer, a bactericide, a biocide, a microemulsion, and the like. The first fluid can also include a gas for foaming the fluid.

The methods can include, after the step of separating the surface from the first fluid, the step of contacting the surface with a second fluid. The step of contacting the surface with the second fluid can be before or after the step of observing. If the step of contacting the surface with the second fluid is after the step of observing the surface for the presence or absence of the first marker, then the methods preferably further include the step of observing the surface for the presence or absence of the first maker after the step of contacting the surface with the second fluid. The second fluid includes a second base fluid. The second base fluid can be aqueous or non-aqueous.

The second fluid can contain additional components including, but not limited to, proppant, a suspending agent, a cross-linker for the suspending agent, a breaker, salt, a breaker aid, a co-surfactant, an oxygen scavenger, an alcohol, a scale inhibitor, a corrosion inhibitor, a fluid-loss additive, an oxidizer, a bactericide, a biocide, a microemulsion, and the like. The second fluid can also include a gas for foaming the fluid.

The second base fluid is different from the first base fluid. For example, the second base fluid can have a different concentration of a surfactant from the first base fluid. Preferably, the second base fluid has a different polarity than the first base fluid, wherein the difference in polarity (measured in relative static permittivity) is at least 20 at 20° C. More preferably, one of the base fluids has a relative static permittivity that is less than 15, and the other base fluid has a relative static permittivity that is greater than 15 at 20° C. Preferably, the first base fluid is aqueous, and the second base fluid is non-aqueous. More preferably, the first base fluid is non-aqueous, and the second base fluid is aqueous.

If the second base fluid is aqueous, then, most preferably, the second base fluid also includes a surfactant. The surfactant can be selected such that an oil-wet surface will become water-wet after the step of contacting the surface with the second fluid. Examples of suitable surfactants are described in U.S. Pat. No. 7,293,609 B2, published on Nov. 13, 2007, having for named inventors Sears T. Dealy, William J. Caveny, Rickey L. Morgan, and Samuel J. Lewis, which is incorporated herein by reference in its entirety. Surfactants described in the above-referenced patent include, but are not limited to, nonylphenol ethoxylates, alcohol ethoxylates, sugar lipids, α-olefinsulfonates, alkylpolyglycosides, alcohol sulfates, salts of ethoxylated alcohol sulfates, alkyl amidopropyl dimethylamine oxides, alkene amidopropyl dimethylamine oxides, and any combination thereof in any proportion. The surfactant can be in a concentration, for example, in the range of 3% to 12% by weight of the aqueous portion of the second fluid.

The first fluid can include a first marker. The second fluid can include a second marker.

The first and second markers can reflect, emit, or be excited to emit a first and second observable property, respectively. Preferably, the first and second observable properties are distinguishable from the reflected, emitted, or excited to be emitted observable properties of the surface.

An observable property can be electromagnetic radiation or radioactivity. Preferably, the first and second observable properties are electromagnetic radiation in the ultraviolet region, the infra-red region, or the visible light region of the electromagnetic spectrum. Most preferably, the electromagnetic radiation is in the visible light region of the electromagnetic spectrum. An example of reflected electromagnetic radiation is a reflected wavelength in the visible region, which can give rise to an observable color. An example of emitted electromagnetic radiation includes luminescence, which can be chemo-luminescence, photo-luminescence, or radio-luminescence. An example of excited to be emitted electromagnetic radiation includes fluorescence.

Preferably, the first marker reflects a wavelength in the visible region. For example, the first marker can be a colored dye with the first observable property being a color. Preferably, the second marker reflects a wavelength in the visible region. Most preferably, the first and second markers reflect wavelengths in the visible region.

Preferably, the first and second observable properties are distinguishable from the reflected, emitted, or excited to be emitted observable properties of: the base fluids and each other. For example, the first observable property can be reflected electromagnetic radiation in the ultraviolet region, and the second observable property can be reflected electromagnetic radiation in the infra-red region. By way of another example, the first observable property can be radioactive, and the second observable property can be electromagnetic radiation. If both the first and second observable properties are reflected wavelengths in the visible region, then the two wavelengths should be different lengths. For example, the first marker can be a first colored dye, and the second marker can be a second colored dye. If colored dyes are used, then the dyes should be different colors. By way of illustration, the first colored dye could be red having a reflected wavelength in the range of 700 nm to 630 nm, and the second colored dye could be blue having a reflected wavelength in the range of 490 nm to 450 nm.

The surface can be contacted with the first fluid under first predetermined conditions. The step of contacting the surface with the second fluid can be under second predetermined conditions. The first and second predetermined conditions include at least a shear rate, a time, and a temperature. Typically, the predetermined conditions are under an ambient pressure (about 1 atmosphere). The first and second predetermined conditions can include additional predetermined conditions, for example, a pressure.

The first and second predetermined conditions can be the same or different. Only one of the conditions can be different, or all of the conditions can be different. For example, the temperature of the first predetermined conditions can be higher than the temperature of the second predetermined conditions. For another example, the shear rate, time, and temperature all can be different.

Each of the predetermined conditions for each of the first and second predetermined conditions can be constant or can vary. For example, the temperature for the first predetermined conditions can vary from an initial temperature to a final temperature. The variance can be made in a stepped or ramped fashion. The shear rate also can be constant or vary. Preferably, the shear rate is at least 25 $sec^{-1}$. More preferably, the shear rate is in the range of 50-350 $sec^{-1}$. For example, only one of the conditions can vary, some of conditions can vary, all of the conditions for the first predetermined conditions can vary, all of the conditions for the second predetermined conditions can vary, or all of the conditions for the first and second predetermined conditions can vary.

The predetermined conditions preferably are selected to simulate wellbore conditions for a given oil or gas operation. Preferably, the shear rate is correlated to a simulated flow rate of a fluid used or to be used in an oil or gas operation. For example, the shear rate can be measured in rotations per min (rpm) and correlated to a flow rate measured in barrels per minute. Preferably, the predetermined time is selected to simulate the time a fluid will come into contact with a wellbore or subterranean formation for a given oil or gas operation. Preferably, the predetermined temperature simulates the downhole temperature for a given oil or gas operation. Typical downhole temperatures are in the range of 40° F.-600° F.

However, depending on the pressure at which a fluid is tested, the predetermined temperature may be limited to the boiling point of the first or second fluid, respectively, at that pressure. The predetermined temperature may be expanded as technology develops. The testing apparatus may have an open test vessel, in which case the testing of a fluid is conducted at ambient pressure. If the testing apparatus is equipped to have a closed, pressurized test vessel, then a fluid can be tested at up to the boiling point of the fluid at the maximum pressure of the test vessel.

If the first or second predetermined conditions include additional predetermined conditions such as pressure, then, preferably, the additional predetermined conditions are selected to simulate wellbore conditions for a given oil or gas operation. For example, the pressure can be selected to simulate the downhole pressure of the wellbore.

The methods provide for separating the surface from the first fluid. If a second fluid is used, then, after the step of contacting the metal surface with the second fluid, the method further includes the step of separating the surface from the second fluid. The steps of separating can include, but are not limited to, removing the surface from the first or second fluid or removing the first or second fluid from the surface. The step of separating the surface from the first fluid can be the same or different from the step of separating the surface from the second fluid. Preferably, the steps of separating do not include wiping or cleaning the surface after the surface is separated from the first and second fluids and before the step of observing.

After the step of separating the first or second fluid, a film of the first or second fluid can remain on the surface. For example, if the first fluid is oil-based, then, after the step of separating, an oil-based film can remain on the surface. This oil-based film can indicate if the surface is oil-wet. If a second fluid is used, then a film of the second fluid can also remain on the surface. The film from the second fluid remaining on the surface can be in addition to a film from the first fluid remaining on the surface.

If a second fluid that includes a second marker is used, then, preferably, the method further includes the step of observing the surface for the presence or absence of the second marker to determine the wettability of the surface after the step of separating the surface from the second fluid.

The step of observing the surface for the presence or absence of the first marker or second marker can include visual observation or the use of a detector. For example, if the marker has a reflected wavelength in the visible range, then visual observation can be used to detect the presence or absence of the marker. If the observable property is ultraviolet or infra-red electromagnetic radiation, then a UV or IR detector or camera can be used. By way of another example, if the marker is radioactive, then a particle detector can be used to detect the presence or absence of the marker.

The marker can be used to qualitatively determine if the surface is oil-wet or water-wet. For example, if the first base fluid is oil and includes a first marker, then the presence of the first marker indicates that the metal surface is oil-wet. By contrast, if the first base fluid is water, then the presence of the first maker indicates that the metal surface is water-wet. If two fluids are used, then the wettability also can be determined by qualitatively observing the dispersion of one marker in relation to the other marker. For example, if the first fluid is non-aqueous and contains a red-colored first marker and the second fluid is aqueous and contains a blue-colored second marker, then the dispersion of the second marker in relation to the first marker can be used to determine the wettability of the surface. For example, if the second marker does not disperse on the surface, then this is indicative of an oil-wet surface. By way of another example, if the second marker does disperse readily on the surface, then this is indicative of a water-wet surface.

According to the inventions, the degree to which the surface is oil-wet, water-wet, or inverting from oil-wet to water-wet can be quantified. For example, if the first or second observable property is radioactive, then a particle detector, such as a Geiger counter, can be used to quantify the wettability of the metal surface. By way of example, if the first marker is red dye and the second marker is blue dye, then the wettability can be quantified by analyzing the relative percentage difference between these two colors. A digital image can be used to visually capture the difference in colors, and the digital image then can be analyzed to calculate the relative percentage difference based on pixel color. One way to calculate the relative percentage difference is to analyze the digital image using "ImageJ" software. ImageJ is a public domain, Java-based image processing program developed at the National Institutes of Health and is currently available at http://rsbweb.nih.gov/ij/.

Once the wettability of the surface is determined, and possibly quantified, then predictions can be made regarding suitable spacer fluids, inverter fluids, and surfactants for use in a given oil or gas operation. These predictions can help determine, for example, whether non-aqueous coatings have inverted such that the aqueous internal phase has inverted with the non-aqueous external phase.

It is to be understood that numerous modifications, alterations, subcombinations, and changes can be made in the invention without departing from the spirit and scope of the invention as set forth in the appended claims. It is the intention to cover all embodiments and forms of the invention within the allowable scope of the claims.

Table 1 illustrates some of the possible method permutations that can be practiced according to the inventions. Other permutations may exist, and the following examples in Table 1 are not meant to limit the inventions to only those examples. If an "x" is located in the "Contact" column, then the surface is contacted with that fluid. If an "x" is located in the "Marker" column, then that fluid contains a marker. If an "x" is located in the "Predetermined conditions" column, then the surface is contacted with that fluid under predetermined conditions. If an "x" is located in the "Observe" column, then the methods include the step of observing for the marker contained in that fluid.

TABLE 1

| Example # | Fluids | Contact | Marker | Predetermined conditions | Observe | Contact | Marker | Predetermined conditions | Observe |
|---|---|---|---|---|---|---|---|---|---|
| 1 | 1st fluid | x | x | x | x | | | | |
| | 2nd fluid | | | | | | | | |
| 2 | 1st fluid | x | | | | | | | |
| | 2nd fluid | | | | | x | x | | x |
| 3 | 1st fluid | x | | | | | | | |
| | 2nd fluid | | | | | x | x | x | x |
| 4 | 1st fluid | x | x | | x | | | | |
| | 2nd fluid | | | | | x | | | |
| 5 | 1st fluid | x | x | | x | | | | |
| | 2nd fluid | | | | | x | x | | |
| 6 | 1st fluid | x | x | | x | | | | |
| | 2nd fluid | | | | | x | x | | x |
| 7 | 1st fluid | x | x | | x | | | | |
| | 2nd fluid | | | | | x | x | x | x |
| 8 | 1st fluid | x | | x | | | | | |
| | 2nd fluid | | | | | x | x | | x |
| 9 | 1st fluid | x | | x | | | | | |
| | 2nd fluid | | | | | x | x | x | x |
| 10 | 1st fluid | x | x | x | x | | | | |
| | 2nd fluid | | | | | x | x | | |
| 11 | 1st fluid | x | x | x | x | | | | |
| | 2nd fluid | | | | | x | | x | |
| 12 | 1st fluid | x | x | x | | | | | |
| | 2nd fluid | | | | | x | x | | x |
| 13 | 1st fluid | x | x | x | | | | | |
| | 2nd fluid | | | | | x | x | x | x |
| 14 | 1st fluid | x | x | x | x | | | | |
| | 2nd fluid | | | | | x | x | x | x |

With reference to Table 1, it is to be understood that the step(s) of observing can occur at various times. For example, if only one of the first or second fluids contains a marker, then the step of observing preferably occurs after the step of separating. By way of a second example, if the first fluid does not contain a marker but the second fluid does, then the step of observing for the second marker preferably occurs after the steps of separating the first fluid and the second fluid. By way of a third example, if the first fluid contains a marker but the second fluid does not, then the step of observing for the first marker can occur: before the step of contacting the surface with the second fluid; after the step of separating the second fluid from the surface; or both, before the step of contacting the surface with the second fluid and after the step of separating the second fluid from the surface. By way of a fourth example, if both, the first fluid and the second fluid contain a marker, then the step of observing for the first marker can occur: before the step of contacting the surface with the second fluid; after the step of separating the second fluid from the surface; or both, before the step of contacting the surface with the second fluid and after the step of separating the second fluid from the surface.

EXAMPLES

To facilitate a better understanding of the present inventions, the following examples of preferred embodiments are given. The following examples are not the only examples which could be given according to the present inventions and are not intended to limit the scope of the inventions.

Figure 2:
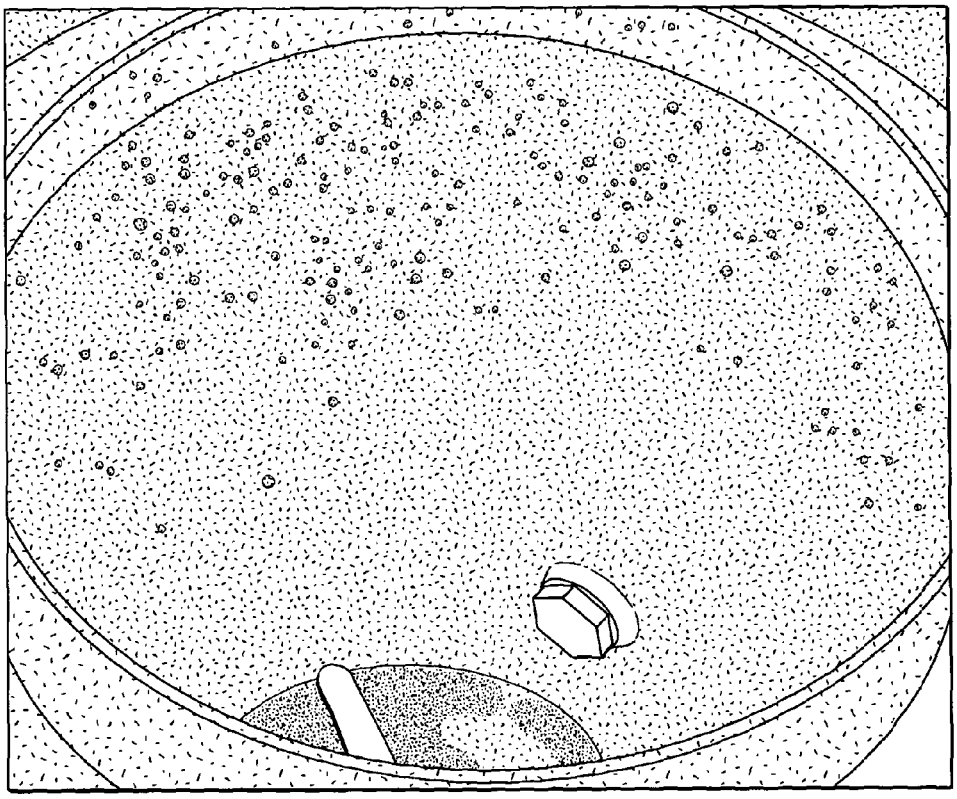
FIG. 2 illustrates an oil-wet surface (the interior metal surface of a testing apparatus) with the use of a non-aqueous fluid containing an oil-soluble red dye as a marker.
Figure 3:
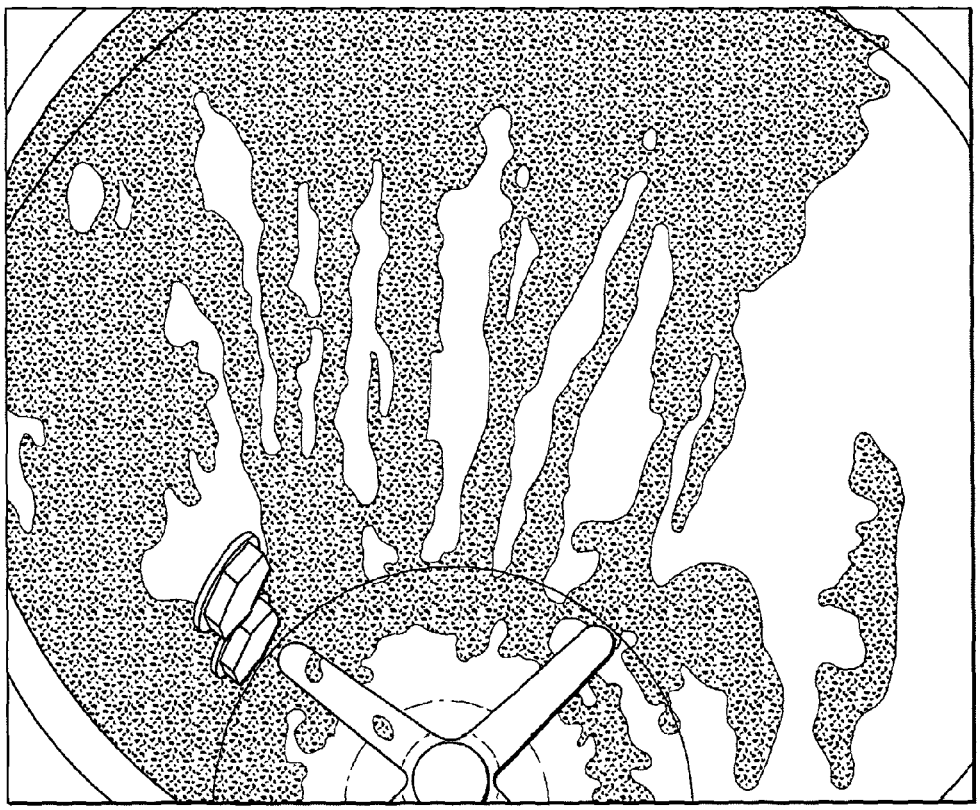
FIG. 3 illustrates a water-wet surface (the interior metal surface of a testing apparatus) with the use of an aqueous fluid containing a water-soluble blue dye as a marker.

FIGS. 1-3 illustrate the results of a method for determining the wettability of a surface with the use of a single fluid containing a marker. The results in FIG. 1 were obtained after a surface was contacted with an oil-based fluid under predetermined conditions. The oil-based fluid contained approximately 75% by volume of diesel and 25% by volume of water. The predetermined conditions were a shear rate of 175 $sec^{-1}$, a time of 10 minutes, and a temperature of 120° F. The surface was then contacted with an aqueous-based fluid containing water-soluble blue dye. The blue dye was "acid blue 80," has the general formula is $C_{32}H_{28}N_2Na_2O_8S_2$, CAS No. 4474-24-2. As can be seen in FIG. 1, the drops of the aqueous-based fluid do not disperse on the surface, which indicates the presence of an oil-wet surface.

The results in FIG. 2 were obtained after a surface was contacted with an oil-based fluid containing oil-soluble red dye under predetermined conditions. The red dye was 1-[[4-[(dimethylphenyl)azo]dimethylphenyl]azo]-2-naphthaleno, CAS No. 1320-06-5. The oil-based fluid contained approximately 75% by volume of diesel and 25% by volume of water. The predetermined conditions were a shear rate of 175 $sec^{-1}$, a time of 10 minutes, and a temperature of 120° F. As can be seen in FIG. 2, the red colored coating on the surface indicates the presence of an oil-wet surface.

The results in FIG. 3 were obtained after a surface was contacted with an oil-based fluid under predetermined conditions. The oil-based fluid contained approximately 75% by volume of diesel and 25% by volume of water. The predetermined conditions were a shear rate of 175 $sec^{-1}$, a time of 10 minutes, and a temperature of 120° F. The surface was then contacted with an aqueous-based fluid containing surfactant and water-soluble blue dye. The dispersive characteristic of the blue dye indicates the presence of a water-wet surface.

Figure 4E:
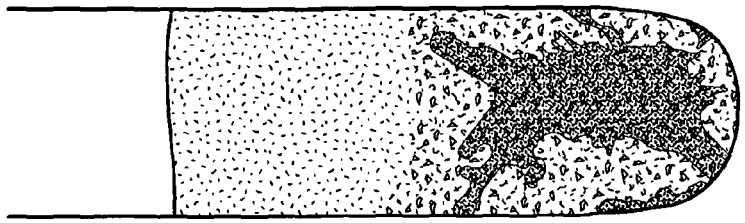
FIGS. 4*a-e* illustrate the results of a method for determining the wettability of a metal surface (the end of a laboratory spatula) conditioned in a testing apparatus with the use of two different fluids containing different dye-colored markers.
Figure 4D:
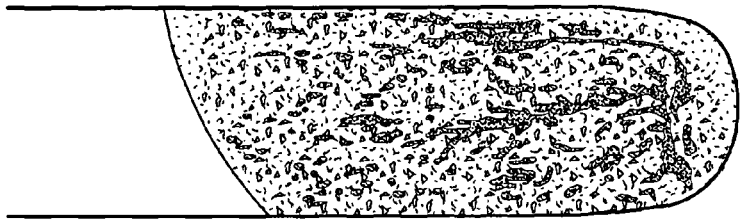
Figure 4C:
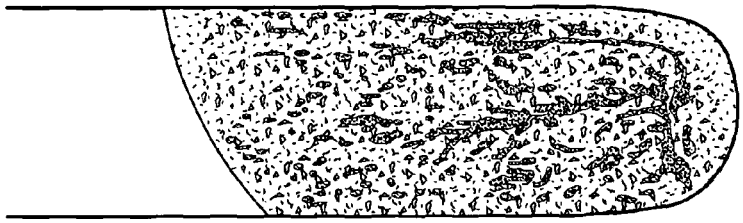
Figure 4B:
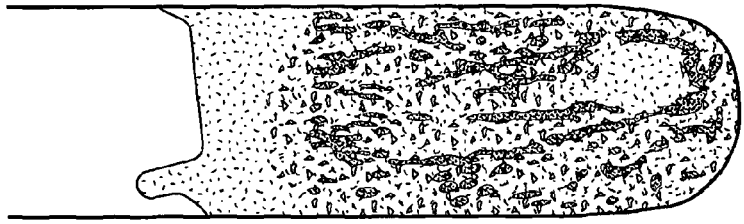
Figure 4A:
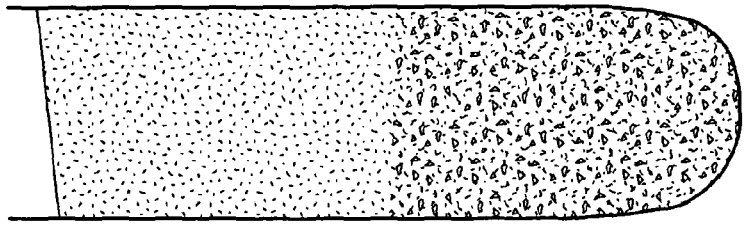

FIGS. 4*a-e* illustrate the results of a method for determining the wettability of a metal surface by use of two fluids, each fluid containing a marker that is different from the other marker. The results in FIGS. 4*a-e* were obtained after the metal surface was contacted with an oil-based fluid containing oil-soluble red dye under predetermined conditions. The oil-based fluid contained approximately 75% by volume of diesel and 25% by volume of water. The predetermined conditions were a shear rate of 175 $sec^{-1}$, a time of 10 minutes, and a temperature of 120° F. The metal surface then was separated from the oil-based fluid. The metal surface then was contacted with an aqueous-based fluid containing water-soluble blue dye under predetermined conditions. FIG. 4*a* shows the results for an aqueous-based fluid that did not contain a surfactant. As can be seen in FIG. 4*a*, the blue dye does not easily disperse, thus, indicating the presence of an oil-wet metal surface. FIGS. 4*b-e* show the results for aqueous-based fluids containing a sequential addition of a surfactant. As can be seen in FIGS. 4*b-e*, the dispersive characteristic of the blue dye indicates that the metal surface transitioned from an oil-wet state to a fully water-wet state.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods can also "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A method of determining the wettability of a surface under predetermined conditions, wherein the surface simulates or is a downhole surface for use in an oil or gas operation, the method comprising the steps of:

(A) selecting a first fluid wherein the first fluid simulates or is a downhole fluid for use in an oil or gas operation;

(B) contacting the surface with the first fluid under first predetermined conditions, (i) wherein the first fluid comprises:

(a) a first base fluid, wherein the first base fluid is aqueous, and wherein the first base fluid has one or more reflected, emitted, or excited to be emitted observable properties; and (b) a first marker, (ii) wherein the first marker is soluble in the first base fluid, and wherein the first marker reflects, emits, or is excited to emit a first observable property, (iii) wherein the first observable property is distinguishable from the reflected, emitted, or excited to be emitted observable properties of the first base fluid, and wherein the first observable property is electromagnetic radiation or radioactivity, and (iv) wherein the first predetermined conditions comprise:

(a) a shear rate;

(b) a time; and (c) a temperature;

(C) separating the surface from the first fluid, wherein after the step of separating, a film of the first fluid can remain on the surface; and (D) observing the surface for the presence or absence of the first marker to determine the wettability of the surface.

2. The method according to claim 1, wherein the downhole surface is a metal.

3. The method according to claim 1, wherein the downhole surface is a portion of a subterranean formation.

4. The method according to claim 1, further comprising, after the step of separating the surface from the first fluid, the step of contacting the surface with a second fluid.

5. The method according to claim 4, wherein the step of contacting the surface with the second fluid is under second predetermined conditions, wherein the second predetermined conditions comprise a shear rate, a time, and a temperature.

6. The method according to claim 4, wherein the second fluid comprises a second base fluid, wherein the second base fluid is aqueous or non-aqueous, wherein the second base fluid is different from the first base fluid, wherein the second base fluid has one or more reflected, emitted, or excited to be emitted observable properties, and wherein the first marker is insoluble in the second base fluid.

7. The method according to claim 6, wherein the second fluid comprises a second marker, wherein the second marker is soluble in the second base fluid and insoluble in the first base fluid, wherein the second marker reflects, emits, or is excited to emit a second observable property that is distinguishable from the reflected, emitted, or excited to be emitted observable properties of the first and second base fluids and the first observable property of the first marker, and wherein the second observable property is selected from the group consisting of electromagnetic radiation and radioactivity.

8. The method according to claim 1, wherein the first observable property is electromagnetic radiation.

9. The method according to claim 8, wherein the electromagnetic radiation is in the ultraviolet region, the infra-red region, or the visible region.

10. The method according to claim 9, wherein the first marker reflects a wavelength in the visible region.

11. The method according to claim 10, wherein the first marker is a colored dye.

12. A method of determining the wettability of a surface under predetermined conditions, wherein the surface simulates or is a downhole surface for use in an oil or gas operation, the method comprising the steps of:

(A) selecting a first fluid wherein the first fluid simulates or is a downhole fluid for use in an oil or gas operation;

(B) contacting the surface with the first fluid under first predetermined conditions, (i) wherein the first fluid comprises:

(a) a first base fluid, wherein the first base fluid is aqueous, wherein the first base fluid comprises a surfactant, and wherein the first base fluid has one or more reflected, emitted, or excited to be emitted observable properties; and (b) a first marker, (ii) wherein the first marker is soluble in the first base fluid, and wherein the first marker reflects emits or is excited to emit a first observable property, (iii) wherein the first observable property is distinguishable from the reflected, emitted, or excited to be emitted observable properties of the first base fluid, and wherein the first observable property is electromagnetic radiation or radioactivity, and (iv) wherein the first predetermined conditions comprise: (a) a shear rate; (b) a time and (c) a temperature;

(C) separating the surface from the first fluid, wherein after the step of separating, a film of the first fluid can remain on the surface; and (D) observing the surface for the presence or absence of the first marker to determine the wettability of the surface.

13. A method of determining the wettability of a surface under predetermined conditions, wherein the surface simulates or is a downhole surface for use in an oil or gas operation, the method comprising the steps of:

(A) selecting a first fluid wherein the first fluid simulates or is a downhole fluid for use in an oil or gas operation;

(B) contacting the surface with the first fluid under first predetermined conditions, (i) wherein the first fluid comprises a first base fluid, (ii) wherein the first base fluid is aqueous or non-aqueous, (iii) wherein the first base fluid has one or more reflected, emitted, or excited to be emitted observable properties, and (iv) wherein the first predetermined conditions comprise: (a) a shear rate; (b) a time; and (c) a temperature;

(C) separating the surface from the first fluid, wherein after the step of separating, a film of the first fluid can remain on the surface;

(D) selecting a second fluid wherein the second fluid simulates or is a downhole fluid for use in an oil or gas operation;

(E) contacting the surface with the second fluid, (i) wherein the second fluid comprises:

(a) a second base fluid, wherein the second base fluid is aqueous or non-aqueous, wherein the second base fluid has one or more reflected, emitted, or excited to be emitted observable properties, and wherein the second base fluid is different from the first base fluid; and (b) a second marker, (ii) wherein the second marker is soluble in the second base fluid and insoluble in the first base fluid, and wherein the second marker reflects, emits, or is excited to emit a second observable property, (iii) wherein the second observable property is distinguishable from the reflected, emitted, or excited to be emitted observable properties of the first and second base fluids, and wherein the second observable property is electromagnetic radiation or radioactivity;

(F) separating the surface from the second fluid, wherein after the step of separating, a film of the second fluid can remain on the surface; and (G) observing the surface for the presence or absence of the second marker to determine the wettability of the surface.

14. The method according to claim 13, wherein the first fluid further comprises a first maker, wherein the first marker is soluble in the first base fluid and insoluble in the second base fluid, wherein the first marker reflects, emits, or is excited to emit a first observable property that is distinguishable from the reflected, emitted, or excited to be emitted observable properties of the first and second base fluids and the second observable property of the second marker, and wherein the first observable property is selected from electromagnetic radiation and radioactivity.

15. The method according to claim 14, wherein the first and second observable properties are electromagnetic radiation.

16. The method according to claim 15, wherein the first and second observable properties are electromagnetic radiation in the visible region.

17. The method according to claim 16, wherein the first and second markers reflect wavelengths in the visible region.

18. The method according to claim 17, wherein the first marker is a first colored dye, and the second marker is a second colored dye.

19. The method according to claim 13, wherein the first base fluid is non-aqueous, and the second base fluid is aqueous.

20. The method according to claim 19, wherein the second fluid comprises a surfactant.

21. The method according to claim 13, wherein the second fluid is contacted with the surface under second predetermined conditions, wherein the second predetermined conditions comprise a shear rate, a time, and a temperature.

22. A method of determining the wettability of a surface under predetermined conditions, wherein the surface simulates or is a downhole surface for use in an oil or gas operation, the method comprising the steps of:

(A) selecting a first fluid wherein the first fluid simulates or is a downhole fluid for use in an oil or gas operation;

(B) contacting the surface with the first fluid under first predetermined conditions, (i) wherein the first fluid comprises:

(a) a first base fluid, wherein the first base fluid is aqueous or non-aqueous, and wherein the first base fluid has one or more reflected, emitted, or excited to be emitted observable properties; and (b) a first marker;

(C) separating the surface from the first fluid, wherein after the step of separating, a film of the first fluid can remain on the surface; and then (D) selecting a second fluid wherein the second fluid simulates or is a downhole fluid for use in an oil or gas operation;

(E) contacting the surface with the second fluid under second predetermined conditions, (i) wherein the second fluid comprises:

(a) a second base fluid, wherein the second base fluid is aqueous or non-aqueous, wherein the second base fluid has one or more reflected, emitted, or excited to be emitted observable properties, and wherein the second base fluid is different from the first base fluid; and (b) a second marker, (ii) wherein the first marker is soluble in the first base fluid and insoluble in the second base fluid, and wherein the first marker reflects, emits, or is excited to emit a first observable property, (iii) wherein the second marker is soluble in the second base fluid and insoluble in the first base fluid, and wherein the second marker reflects, emits, or is excited to emit a second observable property, (iv) wherein the first observable property is distinguishable from the reflected, emitted, or excited to be emitted observable properties of the first and second base fluids, wherein the second observable property is distinguishable from the reflected, emitted, or excited to be emitted observable properties of the first and second base fluids and the first observable property of the first marker, and wherein the first and second observable properties are electromagnetic radiation or radioactivity, (v) wherein the first and second predetermined conditions comprise: (a) a shear rate; (b) a time; and (c) a temperature;

(F) separating the surface from the second fluid, wherein after the step of separating, a film of the second fluid can remain on the surface; and (G) observing the surface for the presence or absence of the first marker and the second marker to determine the wettability of the surface.

* * * * *